US009633518B2

(12) United States Patent
Herbert et al.

(10) Patent No.: US 9,633,518 B2
(45) Date of Patent: Apr. 25, 2017

(54) CONTINUOUS PLAY IN HISTORICAL RACING DEVICES

(71) Applicants: Richard A. Herbert, Riverside, IL (US); William T. Geoghegan, Las Vegas, NV (US)

(72) Inventors: Richard A. Herbert, Riverside, IL (US); William T. Geoghegan, Las Vegas, NV (US)

( * ) Notice: Subject to any disclaimer, the term of this patent is extended or adjusted under 35 U.S.C. 154(b) by 490 days.

(21) Appl. No.: 14/307,081

(22) Filed: Jun. 17, 2014

(65) Prior Publication Data

US 2014/0370976 A1 Dec. 18, 2014

Related U.S. Application Data

(60) Provisional application No. 61/835,969, filed on Jun. 17, 2013.

(51) Int. Cl.
*G07F 17/00* (2006.01)
*G07F 17/32* (2006.01)

(52) U.S. Cl.
CPC ..... *G07F 17/3269* (2013.01); *G07F 17/3288* (2013.01)

(58) Field of Classification Search
USPC ..... 463/16–42
See application file for complete search history.

(56) References Cited

U.S. PATENT DOCUMENTS

| | | | | |
|---|---|---|---|---|
| 6,210,275 | B1 * | 4/2001 | Olsen | G07F 17/32 273/138.1 |
| 7,094,151 | B2 * | 8/2006 | Downes | G07F 17/32 463/25 |
| 8,277,311 | B2 * | 10/2012 | Platis | G06Q 10/06 463/25 |
| 8,506,384 | B2 * | 8/2013 | Coleman | G07F 17/32 463/16 |
| 8,814,648 | B2 * | 8/2014 | Baerlocher | G07F 17/32 463/16 |
| 9,492,735 | B2 * | 11/2016 | Lutnick | |
| 2002/0142843 | A1 * | 10/2002 | Roelofs | A63F 13/10 463/42 |

(Continued)

*Primary Examiner* — Masud Ahmed
(74) *Attorney, Agent, or Firm* — Wood, Phillips, Katz, Clark & Mortimer

(57) ABSTRACT

A system for wagering during a wagering period having a wagering base with a first plurality of pools each with an outcome accessed by an input wager. A plurality of terminals is provided at which wagers are input, each directed to access an outcome in one of the pools. A processing system is configured to process the input wagers in a manner whereby each input wager either: a) accesses; or b) fails to access an outcome. The processing system is further configured so that there is an initial pre-assigned probability of accessing the outcome of each pool through an input wager. The processing system is further configured to identify a collective return by determining the number of input wagers that have accessed an outcome in a particular pool. The processing system is further configured to change the wagering base after the wagering period has begun and before the wagering period is concluded based upon one or more system operating parameters detected during the wagering period.

13 Claims, 1 Drawing Sheet

(56) References Cited

U.S. PATENT DOCUMENTS

| | | | | |
|---|---|---|---|---|
| 2004/0009812 | A1* | 1/2004 | Scott | G07F 17/32 463/28 |
| 2004/0048644 | A1* | 3/2004 | Gerrard | G07F 17/3244 463/16 |
| 2005/0181862 | A1* | 8/2005 | Asher | G06Q 50/34 463/25 |
| 2007/0184890 | A1* | 8/2007 | Ollington | G06Q 50/34 463/17 |
| 2012/0122539 | A1* | 5/2012 | Khal | G07F 17/326 463/19 |

* cited by examiner

CONTINUOUS PLAY IN HISTORICAL RACING DEVICES

CROSS-REFERENCE TO RELATED APPLICATIONS

This application is a non-provisional of Application No. 61/835,969 filed Jun. 17, 2013.

BACKGROUND OF THE INVENTION

Field of the Invention

This invention relates to historical racing devices and, more particularly, to historical racing devices in which multiple betting pools are set up that do not simultaneously open and close over a wagering period.

Background Art

In recent years, Historical Racing has become a commercial reality in the racing industry. The currently deployed system, "Instant Racing" (see Race Tech U.S. Pat. Nos. 6,358,150 and 6,450,887), is established in Arkansas and Kentucky and is anticipated to spread to a number of other states. Another entity developed by one of the inventors herein (see Herbert U.S. Pat. Nos. 5,888,136 and 6,152,822—"the Herbert patents") is currently in existence and being further evolved.

These Historical Racing Devices are actually wagering pari-mutuelly on a track's races, but the races have been completed before the bets are even made (see cited patents for methodologies). However, the devices play in a manner which resembles the playability of fixed odds slot machines with their various entertaining features—yet use a different methodology in doing so, a methodology consistent with the pari-mutuel method of wagering on races as stated in statutes governing such wagering.

A notable difference, however, between fixed odds slots and Historical Racing wagering has been that fixed odds slots play in a continuous manner while Historical Racing has used a game-like method wherein a race-game played for a while, then ended, following by a short interruption, then another race-game proceeded. Conventional race wagering operates in this sequential manner so it is understandable that, up until now, Historical Racing did so also.

SUMMARY OF THE INVENTION

In one form, the invention is directed to a system for wagering during a wagering period. The system includes: a wagering base consisting of a first plurality of pools each with an outcome accessed by an input wager to entitle a bettor to a return; a plurality of terminals at which wagers are input, each directed to access an outcome in one of the pools; and a processing system configured to process the input wagers in a manner whereby each input wager either: a) accesses; or b) fails to access an outcome in the pool to which each input wager is directed. The processing system is further configured so that there is an initial pre-assigned probability of accessing the outcome of each pool through an input wager directed to each pool. The processing system is still further configured to identify a collective return by determining the number of input wagers that have accessed an outcome in a particular pool to which those wagers were directed. The processing system is further configured to change the wagering base after the wagering period has begun and before the wagering period is concluded based upon one or more system operating parameters detected during the wagering period.

In one form, based upon at least a first system operating parameter detected, the processing system is configured to close one of the pools in the first plurality of pools after the wagering period has begun and before the wagering period is concluded.

In one form, based upon at least a first system operating parameter detected, the processing system is configured to open an additional pool through which the processing system interacts, in the same manner that the processing system interacts with the pools in the first plurality of pools, after the wagering period has begun and before the wagering period is concluded.

In one form, based upon at least a first system operating parameter detected, the processing system is configured to: a) close one of the pools in the first plurality of pools; and b) open at least one additional pool through which the processing system interacts, in the same manner that the processing system interacts with the pools in the first plurality of pools, after the wagering period has begun and before the wagering period is concluded.

In one form, the processing system is configured to identify a final return to which each bettor that input a wager directed to the outcome in the one pool that accessed the outcome in the one pool is entitled based upon the collective return for the one pool identified at the time that the one pool is closed.

In one form, the processing system is configured to identify the final return or returns before the wagering period is concluded.

In one form, the one or more system operating parameters detectable is at least one of: a) a number of bettors using the system; b) a dollar value of returns to which bettors are entitled to in a particular pool; c) an anticipated overpayment resulting from chance fluctuations in a particular pool; d) a time period for which a particular pool has been opened; and e) odds inherent within a particular pool.

In one form, the one additional pool replaces the one closed pool and pre-assigned probabilities of accessing the outcome in the one additional pool and one closed pool are the same.

In one form, the one additional pool replaces the one closed pool and the pre-assigned probabilities of accessing the outcome of the one additional pool and one closed pool are different.

In one form, the outcomes in the first plurality of pools are based upon outcomes of events that have already taken place.

In one form, the invention is directed to a method of wagering. The method includes the steps of: providing the system described above; accepting wagers input from the plurality of terminals; through the processing system, ascertaining a status of the system and determining whether at least one system operating parameter is met; and upon determining that the one system operating parameter has been met, changing the wagering base.

In one form, the step of changing the wagering base involves closing at least one pool before the wagering period is concluded.

In one form, the method further includes the step of identifying a return to which each bettor that input a wager directed to the outcome in the one closed pool that accessed the outcome in the one closed pool is entitled before the wagering period is concluded.

In one form, the method further includes the step of making returns identified for the one closed pool available to the bettors entitled to those returns before the wagering period is concluded.

One objective of this invention is to teach a new, continuous system of wagering, utilizable for Historical Racing devices, which by statue are required to wager in the pari-mutuel method. It potentially eliminates the between race-game periods and thereby makes the Historical Racing device play in the more familiar continuous play mode of fixed odds slots. Additionally, by eliminating downtime, this continuous (pari-mutuel) methodology enhances revenue capture. An important market Historical Racing devices are trying to attract—the fixed odds slot player—is more familiar with a device that plays continuously, so this methodology will be more familiar to such players. The present methodology can be adapted, theoretically, to any form of Historical Racing because it is a method of managing the creation, maintenance, and eventual completion of the pari-mutuel pools that must be used by Historical Racing to operate under the legally necessary pari-mutuel wagering system. The methodology potentially removes any play interruption completely.

DETAILED DESCRIPTION OF THE PREFERRED EMBODIMENT

Figure 1:
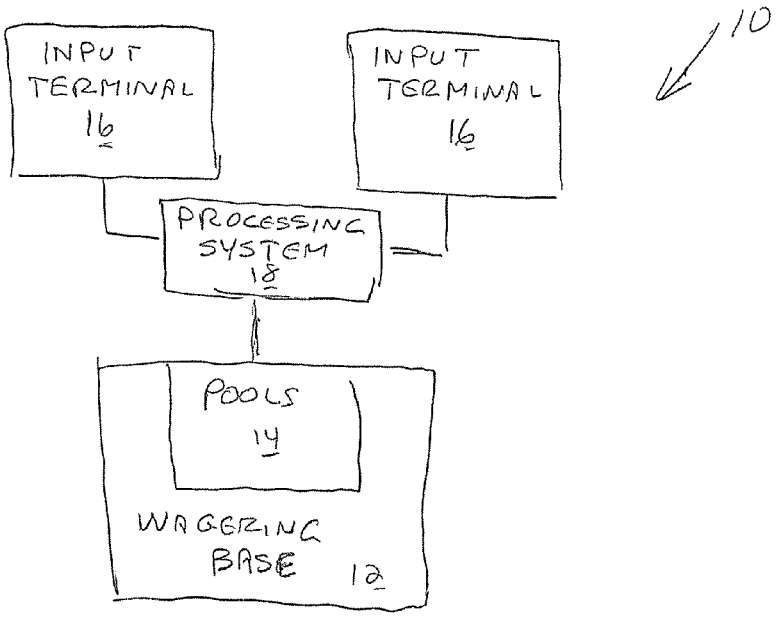
FIG. 1 is a schematic representation of a system for wagering according to the invention.

To illustrate the inventive methodology, as one example, a group of fifty (50) pari-mutuel pools is set up. The Historical Racing bettor is wagering into these multiple pools in the course of regular play. Current methodology: win/loss decisions are made on each bet made into any and/or all the pools. The pools all open and close together. This simplifies the calculations made on the betting results and follows the manner of conventional racing whereby a wagering period is open for multiple and separate pari-mutuel pools simultaneously receiving wagers for a determined time. Then all pools close simultaneously and bets are scanned for wins and losses, and winners in each pool are pari-mutuelly paid, funded by the losing wagers less commissions taken. This is how conventional wagering has always conducted its wagering and it is how the existing operational form of Historical Racing (and the methodology Herbert U.S. Pat. Nos. 5,888,136 and 6,152,822 contemplate) manages its pari-mutuel pools. It has a simplicity to it, in that by starting and ending pools all at once, the wagering calculations are straightforward and simple, with all player accounts trued at once and then a new race-game with a different jackpot is offered. However, a between race-game period intervenes, interrupting play—an unfamiliar event to the fixed odds slots players who make up a large portion of the market for which Historical Racing is competing.

By contrast, the present invention, in order to provide for continuous play teaches that individual pari-mutuel pools may open and close on their own schedule, without relationship to the other forty-nine (49) pools of this example. As a pool opens, operates receiving wagers, then closes, it is replaced by a like category pool (i.e., a win pool is replaced by another win pool, perfecta pool is replaced by another perfecta pool, etc.). But actually, only the odds to win the pool is important to replace with a similar odds pool. (Even here, at times, it may be helpful to replace an expiring pool with a pool with dissimilar odds—depending on what the operator wants to achieve by making such dissimilar replacements.) In such a manner our fifty (50) pool example is in constant flux with pools opening, maturing, and closing—then being replaced by another pool. Thus, the matrix created by the fifty (50) pools remains constant but the pools remain fresh and the maturing pools, perhaps holding much prize money won by the bettors, become quickly available to pay out the prize money, thus preventing a cash flow crisis for the players. By having fifty (50) pools opening and closing at the same time, some pools will be holding back much prize money, creating cash flow delivery problems for the Historical Racing devices. The present invention potentially solves that problem while simultaneously creating continuous, uninterrupted play.

Beyond the scope of this invention are many regulator algorithms (with few examples provided below) that are used to decide when to close any individual pool and with what pool to replace it. These algorithms are used to detect system operating parameters during a wagering period that may dictate system reconfiguration. Some factors are: number of players participating, money won within a pool, the prevention of overpayments by chance fluctuations, the time a pool has already existed, odds inherent within the pool (very high odds pools require more betting into to properly mature as to payout becoming within one to three standard deviations of expected payout). The maintenance of an ideal number of pools smoothes the play operations, as at times it might become appropriate to retire a pool without replacing it because changed conditions of the betting may so dictate. Fewer players participating over time might be better served by reducing the pool matrix from fifty (50) to forty (40) pools. With smaller numbers of players and/or a drop in betting volume, for whatever reason, it may become better for operations to have fewer pools to accept the smaller amounts of money being bet, to maintain proper pool liquidity. At other times it may be advantageous to replace a closing pool with two or three replacement pools as betting players and volume increases. The invention, establishing individual pool independence, allows for much better operational control of the Historical Racing devices while establishing a continuous play mode familiar to fixed odds slots players. Each pool is finite but the matrix whole of pools remains continuous. The ability to access pool funds to maintain adequate cash flow to the players is a marked advancement. With pools opening and closing in synch (old methodology) with each other, there can arise a situation where large amounts of already "won" prize money may not be fully available for 20-30 minutes. This invention prevents such scenarios, smoothes operations, and allows operators to better fine-tune the play according to the number of players participating and the amounts they currently are betting. Yet individual pools closing periodically allows for the completion of all calculations necessary to fully pay (true) each individual wager in a fully pari-mutuel manner identical to the pari-mutuel methods employed by conventional racing. In the Herbert Patents, where divided payments are used to create true final summed pari-mutuel payouts, the ability to close a pool(s) to facilitate the cash flow is a great improvement over having to wait for the entire race-game to end and all fifty (50) pools close, just to access one or two or a few pools that happen to contain a large percentage of outstanding already won funds needed to properly maintain the cash flow to players. At the same time, the closing of pools, which by chance fluctuations may be approaching a state where overpayments are a good possibility, is a preventative of such without having to end a race-game by closing all fifty (50) pools. (Overpayments are most probable with pools having very low win probabilities, where chance may find just a few more than the expected numbers of winners. This is compounded when player numbers are low. Extra winners could result in a case where initial estimated payments exceed the value of the final true pari-mutuel payment)

The foregoing parameters are condensed into algorithms to manage the timing of the pool's creations, their lifespan, their closings, and the creation of their replacement pools in the numbers needed. A pool might exist for only 5-10 minutes or for as long as an hour.

While the foregoing shows the value and advantages of this invention as applied to Historical Racing devices, this methodology, of independent functioning pari-mutuel pools, opens the door to adapting many features of Historical Racing onto fixed odds slot machines. Using pari-mutuel pools that have variable time spans, fixed odds slots can easily be modified to incorporate such features of Historical Racing, such as "changing odds" (the accumulation of a large carryover progressive jackpot, then offering a lower odds jackpot over a timed pari-mutuel pool period in order to distribute the large jackpot to many winners instead of just 1-3 players). By using a piggybacked, timed pari-mutuel pool, on a fixed odds slot, an easy transfer of features of Historical Racing can be incorporated without affecting or changing the fixed odds slot machines which must follow laws, rules, and regulations regarding their methods of play.

The invention can involve a methodology for converting fixed odds slots in a manner that creates a time period for the entire fixed odds game in any particular machine. While this application does allow for the adoption of features of Historical Racing by fixed odds slots, it would also require changes to the operating system (laws, rules, regulations) of the fixed odds devices, such as internalizing a time period within the fixed odds devices. The present invention allows implementation of Historical Racing features onto fixed odds slots, but potentially without changing the device internally. Only a specific pari-mutuel pool (an independent pool)—conducting, for example, a carryover progressive—would be piggybacked onto a fixed odds slot without changing any of the fixed odds slot's internal functions. The operators of the fixed odds slots would only need licensing to be able to operate a pari-mutuel pool, then passively piggyback that pool to the fixed odds slot device in order to adapt features (which could prove attractive to fixed odds slots players) of Historical Racing, that are not now possible for fixed odds slots without this adaptation.

An example of the invention operating with algorithm controls as a fifty (50) pool matrix is the following: in prime hours, 900 players are active and wagering an average bet of 800, eight times per minute. This translates to $5,760 in bets per minute. In managing the pool matrix, of initially fifty (50) pools, a number of algorithms are employed. First, an algorithm monitors each pool's betting balance. With $5760 dollars per minute entering the fifty pools, each pool will be bet into, on average, $115.20. The games commission on "take" will reduce the pool to $103.68 (take @10%) accumulating each minute. As will happen, an average pool will live around thirty minutes, thus accumulating $3,110.40 before closing. A first potential algorithm watches each pool as to the number of winning versus losing bets accumulating into each pool. Let's say this first algorithm is watching for pools accumulating more than the expected $3,110.40 average. By chance fluctuations perhaps this pool has accumulated $3,500.00 while being only fourteen minutes old. While in another development made by one of the inventors herein distribution payouts are managed for some of these accumulated winnings (all of the $3,500.00 accumulated in this example pool in fourteen minutes is due to be paid out to the players as the $3,500.00 represents all the winning plus losing bets minus the commission [take]), a great deal of the $3,500 will remain captured in the pool at the fourteen minute mark. Perhaps, in accordance with a related development by one of the inventors herein, $2,000 of the $3,500 is distributed, leaving $1500 due to be paid to players. Contrast this $1500 sum with an average pool's status at the fourteen minutes mark, which might have only accumulated $1450 dollars (after commissions taken) and in accordance with other contemplated operation, might have paid out $900, leaving the average pool with $550. The algorithm, noting this, will elect to close the larger pool early at the fourteen minute mark, thus freeing up another $1450 to be put into the player cash flow return rather than close the pool containing, at that point, only $550. In such a manner this first algorithm will manage the 50 pool matrix in such a manner as to increase cash flow to the players. This is novel, even in conventional pari-mutuel racing, yet remains fully consistent with all aspects of pari-mutuel wagering pool division rules and regulations.

Further potential algorithms are as follows. (They, too, are completely novel, even in conventional pari-mutuel racing, and comport with all aspects of pari-mutuel wagering. The combined algorithms act in concert with each other and have a hierarchy of controlling instructions to prevent conflicts.) A second algorithm focuses on preventing overpayments that are theoretically possible in individual pari-mutuel pools. Other controls exist to help prevent overpayments but are beyond the scope of this invention. When estimated payments are made as part of the process in making pari-mutuel payouts (see Herbert U.S. Pat. Nos. 5,888,136 and 6,152,882), then just after a bettor wins a bet he/she is paid an "initial estimated payment." Typically, and depending on the bets odds against, an initial payout might be 50% of the expected final odds total payout. Because the final odds cannot be known until a pool closes, it is theoretically possible to make overpayments. For example, say a particular wagering pari-mutuel pool has an odds against to win of 4,000 to 1. Should a player have a 5¢ bet that wins this pool, we would expect (if things went according to expectation of the programmed odds) that our player would end up winning $200. But chance might "decide" our player wins $150, or $250, or some other amount. This happens because the programmed odds often differs from the actual results. One might flip a coin 100 times—an even money proposition—but find results of 64 heads and 36 tails. While a generally safe amount to pay is 50% of expected as an initial estimated payout, when odds are very, very high against, it would prove safer to initially pay perhaps 30% of the expected final payment. But in any case, even if in our example here of 4,000 to 1, we paid $60 initially and then as the pool aged, we made additional "intermediary payments" of another $50, bringing our players total remuneration up to $110 before the pool had closed—we might get a large number of inordinately larger than expected number of winners come in late in the pool's maturation and find that by chance fluctuation the pool would be in a state where the calculated payout (should the pool be closed just then) might be only $100. The second algorithm is designed to monitor such pools that are approaching this point and to shut them down when these conditions are coming close but are not yet there.

A third algorithm might perform the following function. In our example we noted 900 players betting $5,760 per minute into fifty (50) pools. This results in $103.68 accumulating into each pool per minute after commissions of 10% are deducted. Because the invention allows for continuous play, after significant time, perhaps our player population decreases to 300 players. Then we would see only $34.56 net money accumulating in the average pool per minute. In these cases it would be appropriate to contract the number of pools in our fifty (50) pool matrix because in a pari-mutuel based game, pool liquidity is important to stabilize pools and expected payouts. When pari-mutuel pools become "thin" with sparse betting, an Historical Racing game that functions by estimating payouts (see Herbert patents) can have problems with erratic payouts. To prevent such, the third algorithm, monitors the depth of players active and the amounts being bet and would, in this example, not replace some pools as they close, perhaps reducing the pool matrix from fifty (50) down to thirty or twenty-five to stabilize payouts by increasing pool liquidity for each remaining functioning pool. The other side of the function of this third algorithm would occur when, perhaps, our player population increased to 1800 players. But actually as pool liquidity increases, there is no real need to increase pools above fifty (50) if that number of pools function well. But should the number of pools decrease from fifty (50) to thirty (30) as numbers of players and betting decrease and then increase back up again, this third algorithm could add pools by replacing a closing pool with two or three new ones, or even add pools at any point in the continuous play without regarding to other pools closing.

Other algorithms can be used to accomplish other functions that game operators wish to install. In general, these governing algorithms allow the game continuous function by eliminating the need to end a game, closing all the pools when one of the aforementioned problems arise. Instead, the algorithms manage the game and go in and repair the problem by just closing the "offending pool" and replacing it with the appropriate pool, or pools, as the case may be. Continuous play is achieved and using isolated pools allows for easy adaptation of Historical Racing features onto fixed odds slots.

In summary, in one form, the invention allows for continuous play by managing each pari-mutuel pool independently from all the others. Individual pools blink on and off, but the matrix of fifty (50) remains stable as a whole, sometimes increasing or decreasing in total number as conditions warrant. Problems of individual pools don't necessitate a full game shutdown, as only problem pools need be shut down and replaced while the game, as a whole, continues unaffected. Cash flow to players is stabilized, volatility controlled, game play stabilized. The single pool managed concept allows for easy adaptation onto fixed odds slots features of Historical Racing that might prove attractive to the marketplace, and the single managed pool method allows for such adaptation without intruding into the internal mechanisms of fixed odds slots. Finally, the invention potentially does away with pauses between race-games, which will enhance derived revenue by eliminating considerable down time over the course at 24 hours.

A system for wagering during a wagering period, according to the invention, is shown at 10 in FIG. 1. The system 10 is shown in schematic form to encompass virtually an unlimited number of variations of components therein that might be devised by one skilled in the art with the inventive teachings in hand.

The system has a wagering base 12 made up of a first plurality of pools 14 each with an outcome accessed by an input wager to entitle a bettor to a return. A plurality of terminals 16 are provided at which wagers are input, each directed to access an outcome in one of the pools 14. The input terminals 16 may be any number of terminals at the same location or different locations.

A processing system 18 is configured to process the input wagers in a manner whereby each input wager either: a) accesses; or b) fails to access an outcome in the pool to which each input wager is directed. The processing system 18 is configured so that there is an initial pre-assigned probability of accessing the outcome of each pool 14 through an input wager directed to that pool. The processing system 18 is further configured to identify a collective return by determining the number of input wagers that have accessed an outcome in a particular pool to which those wagers were directed. The processing system 18 is further configured to change the wagering base after the wagering period has begun and before the wagering period is concluded based upon one or more system operating parameters detected during the wagering period.

Based upon at least a first system operating parameter detected, the processing system 18 may be configured to close one of the pools in the first plurality of pools after the wagering period has begun and before the wagering period is concluded.

In an alternative form, based upon at least a first system operating parameter detected, the processing system may be configured to open an additional pool, through which the processing system 18 interacts in the same manner that the processing system 18 interacts with the pools in the first plurality of pools, after the wagering period has begun and before the wagering period is concluded.

In one form, based upon at least a first system operating parameter detected, the processing system may be configured to: a) close one of the pools in the first plurality of pools; and b) open at least one additional pool through which the processing system 18 interacts in the same manner that the processing system 18 interacts with the pools in the first plurality of pools, after the wagering period has begun and before the wagering period is concluded.

The processing system 18 is configured to identify a final return to which each bettor, that input a wager directed to the outcome in the one pool that accessed the outcome in the one pool, is entitled based upon the collective return for the one pool identified at the time that the one pool is closed.

The processing system 18 is preferably configured to identify the final return or returns of a closed pool before the wagering period is concluded.

In one form, an added pool replaces a closed pool, with the pre-assigned probabilities of accessing the outcome in the added and closed pools potentially being either the same or different.

The outcomes in the pools may be based upon outcomes of events that have already taken place.

Figure 2:
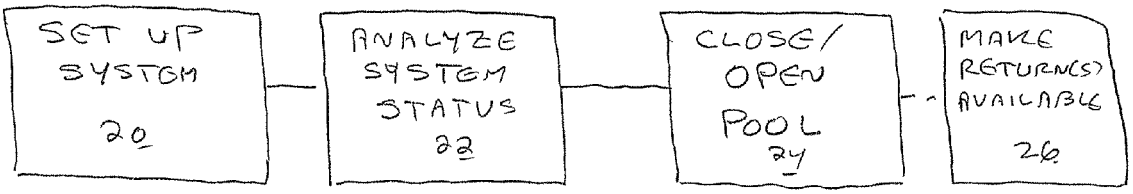
FIG. 2 is a flow diagram representation of a method of wagering, according to the invention, utilizing the system in FIG. 1.

As shown in flow diagram form in FIG. 2, the invention is also directed to a method of wagering. As shown at block 20, a system as described above is provided/set up whereby wagers input from a plurality of terminals are accepted.

As shown at block 22, through the processing system, the system status is analyzed and it is determined whether at least one system operating parameter is met.

As shown at block 24, upon determining that a particular system operating parameter has been met, the wagering base is changed. As one, but not the only, example the number of pools is changed from the number of pools in the first plurality of pools. This may involve closing one or more pools without opening additional pools. Alternatively, one pool may be replaced by one or more pools, etc.

As shown at block 26, after a return is identified for a closed pool, optionally and preferably the return is made available to the bettor entitled to the same before the wagering period is concluded.

The foregoing disclosure of specific embodiments is intended to be illustrative of the broad concepts comprehended by the invention.

The invention claimed is:

1. A system for wagering during a wagering period, the system comprising:

a wagering base comprising a first plurality of pools each with an outcome accessed by an input wager to entitle a bettor to a return;

a plurality of dedicated terminals at which wagers are input via the dedicated input terminal, each input wager directed to access an outcome in one of the pools; and a processing system configured to process the input wagers in a manner whereby each input wager either: a) accesses; or b) fails to access an outcome in the pool to which each input wager is directed, the processing system further configured so that there is an initial preassigned probability of accessing the outcome of each pool through an input wager directed to each pool, the processing system further configured to identify a collective return by determining the number of input wagers that have accessed an outcome in a particular pool to which those wagers were directed, the processing system further configured to change the wagering base after the wagering period has begun and before the wagering period is concluded based upon one or more system operating parameters detected during the wagering period, wherein based upon at least a first system operating parameter detected, the processing system is configured to: a) close one of the pools in the first plurality of pools; and b) open at least one additional pool through which the processing system interacts in the same manner that the processing system interacts with the pools in the first plurality of pools, after the wagering period has begun and before the wagering period is concluded.

2. The system for wagering during a wagering period according to claim 1 wherein based upon at least a first system operating parameter detected, the processing system is configured to close one of the pools in the first plurality of pools after the wagering period has begun and before the wagering period is concluded.

3. The system for wagering during a wagering period according to claim 1 wherein based upon at least a first system operating parameter detected, the processing system is configured to open an additional pool through which the processing system interacts in the same manner that the processing system interacts with the pools in the first plurality of pools, after the wagering period has begun and before the wagering period is concluded.

4. The system for wagering during a wagering period according to claim 2 wherein the processing system is configured to identify a final return to which each bettor that input a wager directed to the outcome in the one pool that accessed the outcome in the one pool is entitled based upon the collective return for the one pool identified at a time that the one pool is closed.

5. The system for wagering during a wagering period according to claim 4 wherein the processing system is configured to identify the final return or returns before the wagering period is concluded.

6. The system for wagering during a wagering period according to claim 1 wherein the one or more system operating parameters detectable is at least one of: a) a number of bettors using the system; and b) a dollar value of returns to which bettors are entitled to in a particular pool; c) an anticipated overpayment resulting from chance fluctuations in a particular pool; d) a time period for which a particular pool has been opened; and e) odds inherent within a particular pool.

7. The system for wagering during a wagering period according to claim 3 wherein the one additional pool replaces the one closed pool, and the pre-assigned probabilities of accessing the outcome in the one additional pool and one closed pool are the same.

8. The system for wagering during a wagering period according to claim 3 wherein the one additional pool replaces the one closed pool and the pre-assigned probabilities of accessing the outcome of the one additional pool and one closed pool are different.

9. The system for wagering during a wagering period according to claim 1 wherein the outcomes in the first plurality of pools are based upon outcomes of events that have already taken place.

10. A method of wagering comprising:

providing the system of claim 1;

accepting wagers input from the plurality of terminals;

through the processing system, ascertaining a status of the system during the wagering period and determining whether at least one system operating parameter is met;

upon determining that the one system operating parameter has been met, changing the wagering base.

11. The method of wagering according to claim 10 wherein the step of changing the wagering base comprises closing at least one pool before the wagering period is concluded.

12. The method of wagering according to claim 11 further comprising the step of identifying a return to which each bettor that input a wager directed to the outcome in the one closed pool that accessed the outcome in the one closed pool is entitled before the wagering period is concluded.

13. The method of wagering according to claim 12 further including the step of making returns identified for the one closed pool available to the bettors entitled to those returns before the wagering period is concluded.

* * * * *